US007918409B2

(12) United States Patent
Schaupp et al.

(10) Patent No.: US 7,918,409 B2
(45) Date of Patent: Apr. 5, 2011

(54) MULTIPLE CHARGING ELECTRODE

(75) Inventors: John F. Schaupp, Sylvania, OH (US); Austin A. Saylor, Sylvania, OH (US)

(73) Assignee: Illinois Tool Works Inc., Glenview, IL (US)

( * ) Notice: Subject to any disclaimer, the term of this patent is extended or adjusted under 35 U.S.C. 154(b) by 82 days.

(21) Appl. No.: 12/100,172

(22) Filed: Apr. 9, 2008

(65) Prior Publication Data

US 2009/0256012 A1 Oct. 15, 2009

(51) Int. Cl.
*B05B 5/00* (2006.01)
*F23D 11/32* (2006.01)

(52) U.S. Cl. ..... 239/707; 239/690.1; 239/692; 239/696; 239/704; 239/706

(58) Field of Classification Search ..... 239/690, 239/690.1, 692, 695, 696, 697, 698, 704, 239/705, 706, 707, 708
See application file for complete search history.

(56) References Cited

U.S. PATENT DOCUMENTS

| | | | | |
|---|---|---|---|---|
| 3,169,882 | A | 2/1965 | Juvinall et al. | |
| 3,169,883 | A | 2/1965 | Juvinall | |
| 3,764,068 | A * | 10/1973 | Lacchia | 239/3 |
| 3,940,061 | A | 2/1976 | Gimple et al. | |
| 3,964,683 | A | 6/1976 | Gimple | |
| 3,990,609 | A | 11/1976 | Grant | |
| 4,001,935 | A | 1/1977 | Krohn et al. | |
| 4,002,777 | A | 1/1977 | Juvinall et al. | |
| 4,011,991 | A * | 3/1977 | Masuda | 239/708 |
| 4,020,393 | A | 4/1977 | Porter | |
| 4,030,857 | A | 6/1977 | Smith, Jr. | |
| 4,037,561 | A | 7/1977 | LaFave et al. | |
| 4,066,041 | A | 1/1978 | Buschor et al. | |
| 4,081,904 | A | 4/1978 | Krohn et al. | |
| 4,105,164 | A | 8/1978 | Lau et al. | |
| 4,114,564 | A | 9/1978 | Probst | |
| 4,116,364 | A | 9/1978 | Culbertson et al. | |
| 4,133,483 | A | 1/1979 | Henderson | |
| D252,097 | S | 6/1979 | Probst et al. | |
| 4,165,022 | A | 8/1979 | Bentley et al. | |
| 4,169,545 | A | 10/1979 | Decker | |
| 4,171,100 | A * | 10/1979 | Benedek et al. | 239/700 |
| 4,174,070 | A | 11/1979 | Lau et al. | |
| 4,174,071 | A | 11/1979 | Lau et al. | |

(Continued)

FOREIGN PATENT DOCUMENTS

GB 2 022 464 A 12/1979

(Continued)

OTHER PUBLICATIONS

"M90 Handguns", Service Manual, Ransburg, 2005, 48 pages.

(Continued)

*Primary Examiner* — Dinh Q Nguyen
*Assistant Examiner* — Ryan Reis
(74) *Attorney, Agent, or Firm* — Barnes & Thornburg LLP

(57) ABSTRACT

A device for dispensing coating material includes at least two electrodes for coupling to at least one high-magnitude potential supply so that the at least two electrodes are maintained substantially at two different high-magnitude potentials so that an electric field exists between the at least two electrodes. At least one of the at least two electrodes includes a passageway extending therethrough to provide a flow of compressed gas through the at least one of the at least two electrodes.

7 Claims, 1 Drawing Sheet

U.S. PATENT DOCUMENTS 4,214,709 A 7/1980 Scull et al.
4,228,961 A * 10/1980 Itoh ..... 239/698
4,248,386 A 2/1981 Morle
4,266,721 A 5/1981 Sickles
4,285,446 A 8/1981 Rapp et al.
4,289,278 A * 9/1981 Itoh ..... 239/706
4,331,298 A 5/1982 Bentley et al.
RE30,968 E 6/1982 Grant
4,361,283 A 11/1982 Hetherington et al.
D270,179 S 8/1983 Grime
D270,180 S 8/1983 Grime
D270,367 S 8/1983 Grime
D270,368 S 8/1983 Grime
4,401,268 A 8/1983 Pomponi, Jr.
4,433,812 A 2/1984 Grime
4,437,614 A 3/1984 Garcowski
4,453,670 A 6/1984 Sirovy
4,483,483 A 11/1984 Grime
4,513,913 A 4/1985 Smith
4,529,131 A * 7/1985 Rutz ..... 239/690
4,537,357 A 8/1985 Culbertson et al.
4,572,438 A 2/1986 Traylor
4,606,501 A 8/1986 Bate et al.
4,613,082 A 9/1986 Gimple et al.
D287,266 S 12/1986 Knetl et al.
4,702,420 A 10/1987 Rath
4,747,546 A 5/1988 Talacko
4,759,502 A 7/1988 Pomponi, Jr. et al.
4,760,962 A 8/1988 Wheeler
4,770,117 A 9/1988 Hetherington et al.
4,819,879 A 4/1989 Sharpless et al.
4,844,342 A 7/1989 Foley
D303,139 S 8/1989 Morgan
D305,057 S 12/1989 Morgan
D305,452 S 1/1990 Morgan
D305,453 S 1/1990 Morgan
4,911,367 A 3/1990 Lasley
4,921,172 A 5/1990 Belmain et al.
4,927,079 A 5/1990 Smith
4,934,603 A 6/1990 Lasley
4,934,607 A 6/1990 Lasley
4,993,645 A 2/1991 Buschor
5,011,086 A * 4/1991 Sonnleitner et al. ..... 239/691
5,022,590 A 6/1991 Buschor
D318,712 S 7/1991 Buschor
5,039,019 A 8/1991 Weinstein et al.
5,054,687 A 10/1991 Burns et al.
5,064,119 A 11/1991 Mellette
5,074,466 A 12/1991 Santiago
5,090,623 A 2/1992 Burns et al.
D325,241 S 4/1992 Buschor
5,118,080 A 6/1992 Hartmann
5,119,992 A 6/1992 Grime
5,148,080 A 9/1992 Van Thyne
5,178,330 A 1/1993 Rodgers
5,180,104 A 1/1993 Mellette
5,209,365 A 5/1993 Wood
5,209,405 A 5/1993 Robinson et al.
5,236,129 A 8/1993 Grime et al.
5,284,299 A 2/1994 Medlock
5,284,301 A 2/1994 Kieffer
5,289,974 A 3/1994 Grime et al.
5,299,740 A 4/1994 Bert
5,303,865 A 4/1994 Bert
5,330,108 A 7/1994 Grime et al.
5,332,156 A 7/1994 Wheeler
5,332,159 A 7/1994 Grime et al.
D349,559 S 8/1994 Vanderhoef et al.
5,351,887 A 10/1994 Heterington et al.
5,351,903 A * 10/1994 Mazakas et al. ..... 239/705
5,395,054 A 3/1995 Wheeler
5,400,971 A 3/1995 Maugans et al.
5,553,788 A 9/1996 Del Gaone et al.
5,582,350 A 12/1996 Kosmyna et al.
5,618,001 A 4/1997 Del Gaone et al.
5,639,027 A 6/1997 Fritz
RE35,769 E 4/1998 Grime et al.
5,803,313 A 9/1998 Flatt et al.
5,829,679 A 11/1998 Strong
5,836,517 A 11/1998 Burns et al.
5,907,469 A * 5/1999 Kim et al. ..... 361/225
RE36,378 E 11/1999 Mellette
6,003,794 A 12/1999 Hartman et al.
6,179,223 B1 1/2001 Sherman et al.
6,189,809 B1 2/2001 Schwebemeyer
6,276,616 B1 8/2001 Jenkins
6,402,058 B2 6/2002 Kaneko et al.
6,460,787 B1 10/2002 Hartle et al.
6,572,029 B1 6/2003 Holt
6,669,112 B2 12/2003 Reetz, III et al.
6,679,193 B2 1/2004 Shutic et al.
6,698,670 B1 3/2004 Gosis et al.
6,712,292 B1 3/2004 Gosis et al.
RE38,526 E 6/2004 Hansinger et al.
6,758,425 B2 7/2004 Michael
6,776,362 B2 8/2004 Kawamoto et al.
6,790,285 B2 9/2004 Matsumoto
6,796,519 B1 9/2004 Knobbe et al.
6,817,553 B2 11/2004 Steur
6,854,672 B2 2/2005 Allen
6,877,681 B2 4/2005 Hartle et al.
6,916,023 B2 7/2005 Alexander et al.
6,929,698 B2 8/2005 Shutic et al.
6,951,309 B2 10/2005 Buschor et al.
6,955,724 B2 10/2005 Dankert
7,128,277 B2 10/2006 Schaupp
7,143,963 B2 12/2006 Tani et al.
7,166,164 B2 1/2007 Shutic et al.
7,217,442 B2 5/2007 Wilt et al.
7,247,205 B2 7/2007 Shutic et al.
7,292,322 B2 11/2007 Boroditsky et al.
7,296,759 B2 11/2007 Alexander et al.
7,296,760 B2 11/2007 Alexander et al.
2003/0006322 A1 1/2003 Hartle et al.
2003/0197078 A1 10/2003 Mauchle et al.
2006/0081729 A1 4/2006 Nagal

FOREIGN PATENT DOCUMENTS

WO 01/85353 A1 11/2001
WO 2005/014177 A1 2/2005

OTHER PUBLICATIONS

"REA-70 and REA-70L Electrostastic Spray Guns Dual Atomization Technology", Service Manual, Ransburg, 41 pages.
"Automatic R-E-A III Electrostatic Spray or R-E-A III-L Electrostatic HVLP Spray", ITW Ransburg Electrostatic Systems, 1996, 2 pages.
"REA-IV and REA-IVL Delta Electrostatic Spray Guns, Dual Atomization Technology", Service Manual, ITW Ransburg Electrostatic Systems, 1998, 27 pages, Addendum, 2005, 4 pages.
REA-90A and REA-90LA Automatic Electrostatic Spray Guns, Service Manual, ITW Ransburg, 2006, 44 pages.
International search report from related PCT/EP2009/038018 dated Jun. 23, 2009.
http://www.fmglobal.com/assets/pdf/fmapprovals/7260.pdf, chapters 5 and 6.

* cited by examiner

MULTIPLE CHARGING ELECTRODE

FIELD OF THE INVENTION

This invention relates to electrode configurations and potential supplies for coating dispensing devices (hereinafter sometimes spray guns or guns).

BACKGROUND

Various types of manual and automatic spray guns are known. There are, for example, the automatic and manual spray guns illustrated and described in the following listed U.S. patents and published applications: 2006/0081729; 2003/0006322; U.S. Pat. Nos. 7,296,760; 7,296,759; 7,292,322; 7,247,205; 7,217,442; 7,166,164; 7,143,963; 7,128,277; 6,955,724; 6,951,309; 6,929,698; 6,916,023; 6,877,681; 6,854,672; 6,817,553; 6,796,519; 6,790,285; 6,776,362; 6,758,425; RE38,526; 6,712,292; 6,698,670; 6,679,193; 6,669,112; 6,572,029; 6,460,787; 6,402,058; U.S. Pat. Nos. RE36,378; 6,276,616; 6,189,809; 6,179,223; 5,836,517; 5,829,679; 5,803,313; U.S. Pat. Nos. RE35,769; 5,639,027; 5,618,001; 5,582,350; 5,553,788; 5,400,971; 5,395,054; D349,559; 5,351,887; 5,332,159; 5,332,156; 5,330,108; 5,303,865; 5,299,740; 5,289,974; 5,284,301; 5,284,299; 5,236,129; 5,209,405; 5,209,365; 5,178,330; 5,119,992; 5,118,080; 5,180,104; D325,241; 5,090,623; 5,074,466; 5,064,119; 5,054,687; 5,039,019; D318,712; 5,022,590; 4,993,645; 4,934,607; 4,934,603; 4,927,079; 4,921,172; 4,911,367; D305,453; D305,452; D305,057; D303,139; 4,844,342; 4,819,879; 4,770,117; 4,760,962; 4,759,502; 4,747,546; 4,702,420; 4,613,082; 4,606,501; 4,572,438; D287,266; 4,537,357; 4,529,131; 4,513,913; 4,483,483; 4,453,670; 4,437,614; 4,433,812; 4,401,268; 4,361,283; D270,368; D270,367; D270,180; D270,179; RE30,968; 4,331,298; 4,289,278; 4,285,446; 4,266,721; 4,248,386; 4,214,709; 4,174,071; 4,174,070; 4,171,100; 4,169,545; 4,165,022; D252,097; 4,133,483; 4,116,364; 4,114,564; 4,105,164; 4,081,904; 4,066,041; 4,037,561; 4,030,857; 4,020,393; 4,002,777; 4,001,935; 3,990,609; 3,964,683; 3,940,061; 3,169,883; and, 3,169,882. There are also the disclosures of WO 2005/014177 and WO 01/85353. There are also the Ransburg model REA 3, REA 4, REA 70, REA 90, REM and M-90 guns, all available from ITW Ransburg, 320 Phillips Avenue, Toledo, Ohio, 43612-1493.

The disclosures of these references are hereby incorporated herein by reference. The above listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a device for dispensing coating material includes at least two electrodes for coupling to at least one high-magnitude potential supply so that the at least two electrodes are maintained substantially at two different high-magnitude potentials so that an electric field exists between the at least two electrodes. At least one of the at least two electrodes includes a passageway extending therethrough to provide a flow of compressed gas through the at least one of the at least two electrodes.

Illustratively, a voltage divider is coupled to the at least one high-magnitude potential supply. The at least two electrodes are coupled to different points on the voltage divider to maintain the at least two electrodes substantially at two different high-magnitude potentials.

Alternatively illustratively, two high-magnitude potential supplies having high-magnitude potential output ports provide the two different high-magnitude potentials. Each high-magnitude potential output port is coupled to a respective one of the at least two electrodes.

Illustratively, each of the at least two electrodes includes a passageway extending therethrough to provide flows of compressed gas through the at least two electrodes.

Illustratively, the at least two electrodes are coupled to a common source of compressed gas.

Alternatively illustratively, the at least two electrodes are coupled to respective ones of at least two sources of compressed gas.

Illustratively, the device is selected from the group consisting of pneumatic atomizers, pneumatically-assisted hydraulic atomizers, high-volume, low pressure pneumatic (HVLP) atomizers and hydraulic atomizers.

Alternatively illustratively, the device comprises a device for dispensing pulverulent coating material (hereinafter sometimes coating powder or powder).

BRIEF DESCRIPTION OF THE DRAWINGS

The invention may best be understood by referring to the following detailed description and accompanying drawings which illustrate the invention. In the drawings.

DETAILED DESCRIPTION OF ILLUSTRATIVE EMBODIMENTS

Figure 1:
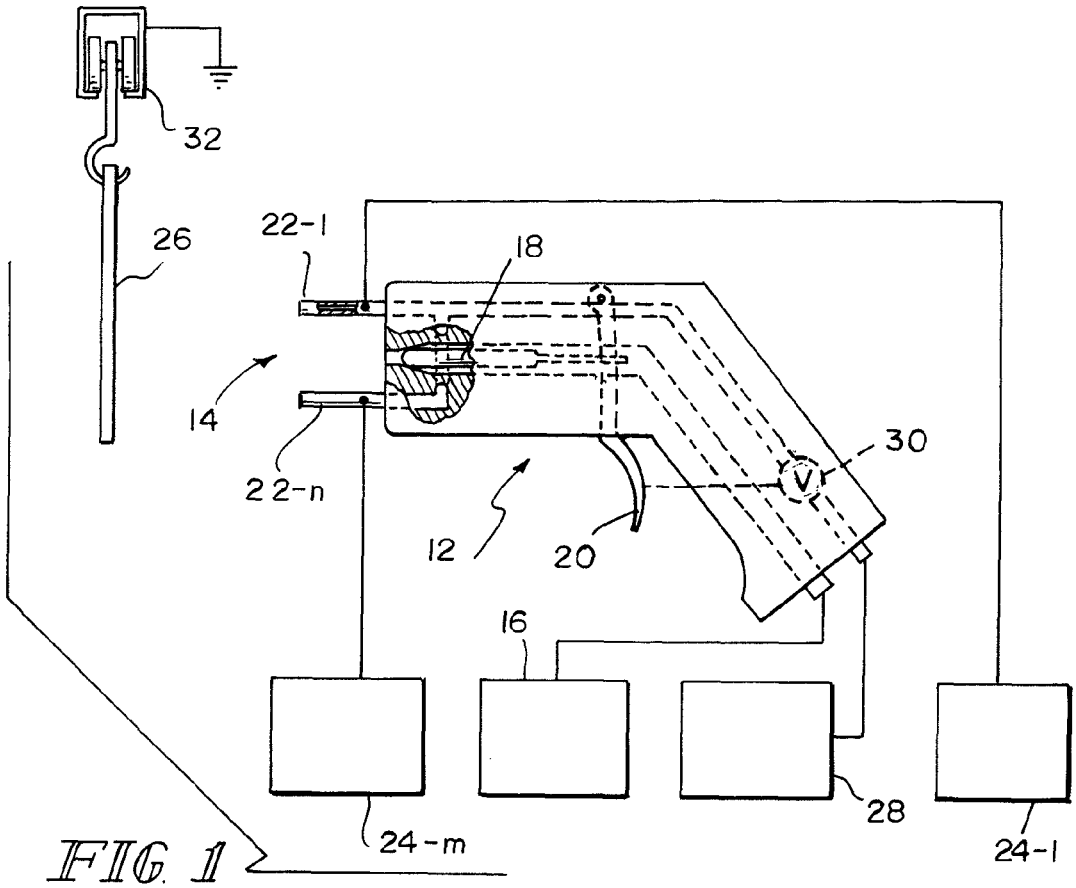
FIG. 1 illustrates a highly diagrammatic side elevational view of a system constructed according to the invention.

FIG. 1 illustrates a coating dispensing system 10 including a coating dispensing device, or gun, 12. Device 12 illustratively is a manual spray gun, although it should be understood that the invention is equally applicable to so-called automatic spray guns as well. Additionally, while the illustrated gun 12 is a hydraulic gun, the invention is equally applicable to pneumatic (hereinafter sometimes air), pneumatically assisted hydraulic (hereinafter sometimes AAA), and high-volume, low-pressure pneumatic (hereinafter sometimes HVLP) guns. Additionally, the invention is equally applicable to coating dispensing devices for dispensing coating powders. Gun 12 includes a nozzle 14 through which coating material from a source 16 is dispensed under the control of a valve 18. Source 16 may be a source of liquid coating material or a source of coating powder such as, for example, a fluidized bed. The position of valve 18 needle is, in turn, controlled by the gun 12 trigger 20 position. On a manual gun, trigger 20 position is controlled by hand by an operator. On an automatic gun, trigger 20 position is typically controlled by a process controller, such as, for example, an Allen-Bradley controller.

The coating material dispensed through nozzle 14 is charged by two or more electrodes 22-1, . . . **22-*n*, only two of which are illustrated in the drawings. Electrodes 22-1, . . . 22-*n*** are in the form of hollow needles or small gauge tubes.

Different high-magnitude (typically negative) electrostatic potentials are coupled from (a) high-magnitude potential source(s) 24-1, . . . 24-*m*, to electrodes 22-1, . . . 22-*n*. In this way, (an) electric field(s) exist(s) not only between each electrode 22-1, . . . 22-*n* articles 26 (hereinafter sometimes targets) to be coated by the coating material dispensed through nozzle 14, but also between the electrodes 22-1, . . . 22-*n* themselves. Additionally, compressed gas, illustratively air, is supplied from a source 28 of compressed gas, illustratively through a valve 30 controlled by the trigger 20 position, to the base of each electrode 22-1, . . . 22-*n*. Thus, as coating material is flowing through nozzle 14, compressed gas is flowing through electrodes 22-1, . . . 22-*n*. This assists in maintaining the electrodes 22-1, . . . 22-*n* relatively free of coating material. This assists in the flow of charge from electrodes 22-1, . . . 22-*n* to the coating material as it is being dispensed, which, in turn, improves the transfer efficiency of coating material to the targets 26 as they are presented in front of gun 12, illustratively on a grounded conveyor 32, for coating.

Figure 2:
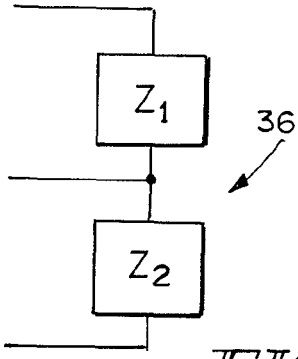
FIG. 2 highly diagrammatically illustrates an alternative detail to a detail illustrated in FIG. 1.
Figure 3:
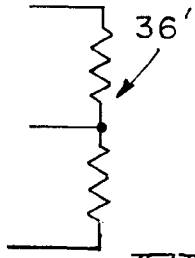
FIG. 3 highly diagrammatically illustrates an alternative detail to a detail illustrated in FIG. 1.
Figure 4:
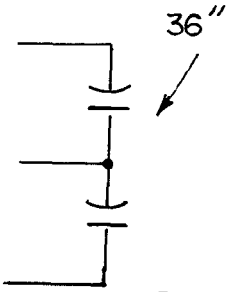
FIG. 4 highly diagrammatically illustrates an alternative detail to a detail illustrated in FIG. 1; and, FIG. 5 highly diagrammatically illustrates an alternative detail to a detail illustrated in FIG. 1.

The high-magnitude potential source(s) 24-1, . . . 24-*m* need not be separate power supplies. Instead, they can be provided by a common supply feeding a voltage divider 36 characterized by impedances $z_1$ and $z_2$ which may be provided within the body of gun 12, or may be provided within the power supply, or may be a separate voltage divider to which the power supply and electrodes 22-1, . . . 22-*n* are coupled. The generalized impedance voltage divider 36 is illustrated in FIG. 2. The voltage divider may, for example, take the form of a resistive voltage divider 36' illustrated in FIG. 3. It may also take the form of a capacitive voltage divider 36" illustrated in FIG. 4, with the constraint that the capacitances must be sufficiently small that the divider cannot store so much charge Q=CV as to create hazardous operating conditions in the coating environment.

It should also be understood that while the resistors and capacitors of the various voltage dividers 36, 36', 36" are illustrated as separate components, one or more of these may be components, a resistor or capacitor, for example, that are already incorporated into the gun 12 for other known purposes, such as, for example, as part of a high voltage rectifier and multiplier. Ordinarily, these are Cockcroft-Walton multipliers, sometimes referred to as cascades.

Figure 5:
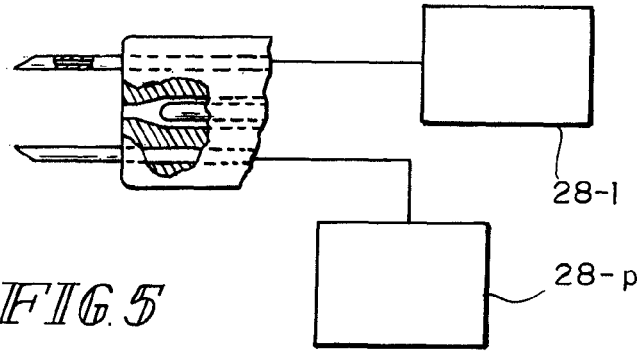

Additionally, it should be understood that, while the supplies of compressed gas to the bases of the electrodes 22-1, . . . 22-*n* are illustrated as originating from a common source 28 of compressed gas, the electrodes 22-1, . . . 22-*n* may be supplied from two or more sources 28-1, . . . 28-*p* through respective valves 30-1, . . . 30-*p* under the control of trigger 20. This is illustrated in FIG. 5. Also in FIG. 5, the tube electrodes are illustrated as having outer ends beveled at angles of about 30°. Ordinarily, the angle of bevel should not be less than about 30°, as the ends of the tubes become "hot spots" for potential electrostatic discharge.

What is claimed is:

1. A device for dispensing coating material, the device including at least two electrodes for coupling to at least one high-magnitude potential supply so that the at least two electrodes are maintained substantially at two different high-magnitude potentials so that an electric field exists between the at least two electrodes, each of the at least two electrodes includes a passageway extending therethrough to provide a flow of compressed gas through the at least two electrodes.

2. The apparatus of claim 1 further including a voltage divider coupled to the at least one high-magnitude potential supply, the at least two electrodes being coupled to different points on the voltage divider to maintain the at least two electrodes substantially at two different high-magnitude potentials.

3. The apparatus of claim 1 comprising two high-magnitude potential supplies having high-magnitude potential output ports providing said two different high-magnitude potentials, each high-magnitude potential output port coupled to a respective one of the at least two electrodes.

4. The apparatus of claim 1 wherein the at least two electrodes are coupled to a common source of compressed gas.

5. The apparatus of claim 1 wherein the at least two electrodes are coupled to respective ones of at least two sources of compressed gas.

6. The device of claim 1 selected from the group consisting of pneumatic atomizers, pneumatically-assisted hydraulic atomizers, high-volume, low pressure pneumatic (HVLP) atomizers and hydraulic atomizers.

7. The device of claim 1 for dispensing pulverulent coating material.

* * * * *